United States Patent [19]

Rosendall et al.

[11] 4,282,622

[45] Aug. 11, 1981

[54] FLOOR SWEEPER WITH INTEGRAL HOUSING

[75] Inventors: Henry J. Rosendall; Arlan J. Shaffer, both of Grand Rapids, Mich.

[73] Assignee: Bissell, Inc., Grand Rapids, Mich.

[21] Appl. No.: 99,555

[22] Filed: Dec. 13, 1979

[51] Int. Cl.[3] ..... A47L 11/00

[52] U.S. Cl. ..... 15/41 R

[58] Field of Search ..... 15/41–46, 15/48, 79 R

[56] References Cited

U.S. PATENT DOCUMENTS

| | | | |
|---|---|---|---|
| 3,789,454 | 2/1974 | Drappeau et al. | 15/41 R |
| 3,871,047 | 3/1975 | Kaburaki et al. | 15/42 |

FOREIGN PATENT DOCUMENTS

| | | | |
|---|---|---|---|
| 875492 | 8/1961 | United Kingdom | 15/41 R |

*Primary Examiner*—Edward L. Roberts

*Attorney, Agent, or Firm*—Andrus, Sceales, Starke & Sawall

[57] ABSTRACT

A floor sweeper is constructed from a single integral plastic housing having a top and downwardly extending rear and end walls. The front end portion of the housing is uniquely formed with the front edge of the top set back from the sweeper periphery, said edge merging into an integral deflector which extends downwardly beneath the housing adjacent the rotary brusy. The lower extremity of the deflector is connected to the front peripheral housing portion by an integral platform which, together with the deflector, forms an elongated transversely extending trough-like channel on the upper exposed side of the housing front end. The channel has end walls which are spaced inwardly from the housing end walls to form downwardly facing wheel-receiving recesses. The front sweeper wheels are freely mounted on the ends of an axle which extends through the channel and its end walls, with the wheels being trapped within their respective recesses. The channel is provided with a removable cover of flexible stretchable material, both for appearances sake and to prevent dust and debris from entering the channel. The cover is resilient and further serves as a bumper for the front of the sweeper. A dust pan is disposed behind the rotary brush, with the top side of the pan bottom forming a floor having a raised transverse rib which helps prevent shifting of dust and debris either toward or away from the brush. The under side of the rib beneath the pan forms a slot which receives the axle for the rear sweeper wheels.

12 Claims, 5 Drawing Figures

FLOOR SWEEPER WITH INTEGRAL HOUSING

U.S. PRIOR ART OF INTEREST

U.S. Pat. No. 3,789,454 Drappeu et al Feb. 5, 1974; U.S. Pat. No. 3,871,047 Kaburaki et al Mar. 18, 1975.

BACKGROUND AND SUMMARY OF THE INVENTION

This invention relates to a floor sweeper with an integral housing.

It is aleady known to construct a floor sweeper having an upper housing of molded plastic, and having a separate curved deflector member of metal suitably secured to the underside of the housing and positioned to deflect dirt and debris into the dust pan.

In addition, it is also known, as in the above-identified U.S. Pat. No. 3,789,454, to construct a floor sweeper having separate molded plastic upper and lower housing portions, with the lower portion having an integral curved deflecting wall extending upwardly in front of the brush.

Furthermore, it is known to provide raised shoulders in the floor of the sweeper dust pan to reduce shifting of dust and debris in the pan toward the rotary brush, as in the above-identified U.S. Pat. No. 3,871,047.

It is a task of the present invention to provide a simpler and more convenient floor sweeper structure having fewer parts, which eliminates the separate metal deflector in one instance, and which eliminates the separate lower housing portion in another instance.

It is a further task of the present invention to reduce shifting of dust and debris in the dust pan, not only toward but also away from the rotary brush.

In accordance with one aspect of the invention, the floor sweeper is constructed with a plastic housing having a top and downwardly extending rear and end walls. The front end portion of the housing is uniquely formed with the front edge of the top set back from the sweeper periphery, said edge merging into an integral deflector which extends downwardly beneath the housing adjacent the rotary brush. The lower extremity of the deflector is connected to the front peripheral housing portion by an integral platform which, together with the deflector, forms an elongated transversely extending trough-like channel on the upper exposed side of the housing front end. The channel is provided with strengthening ribs.

In accordance with another aspect of the invention, the channel has end walls which are spaced inwardly from the housing end walls to form downwardly facing wheel-receiving recesses. The front sweeper wheels are freely mounted on the ends of an axle which extends through the channel and its end walls, with the wheels being trapped within their respective recesses.

In accordance with yet another aspect of the invention, the channel is provided with a removable cover of flexible stretchable material, both for appearances sake and to prevent dust and debris from entering the channel. The cover is resilient and further serves as a bumper for the front of the sweeper.

In accordance with a further aspect of the invention, a dust pan is disposed behind the rotary brush, with the top side of the pan bottom forming a floor having a raised transverse rib which helps prevent shifting of dust and debris either toward or away from the brush.

The under side of the rib beneath the pan forms a slot which receives the axle for the rear sweeper wheels.

BRIEF DESCRIPTION OF THE DRAWINGS

The accompanying drawings illustrate the best mode presently contemplated by the inventors for carrying out the invention.

In the drawings.

DESCRIPTION OF THE PREFERRED EMBODIMENT

Figure 1:
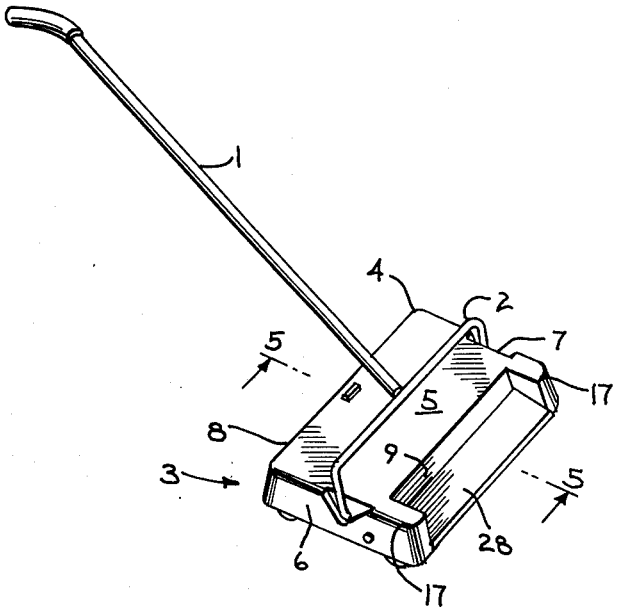
FIG. 1 is a perspective view of a floor sweeper constructed in accordance with the various aspects of the invention.
Figure 2:
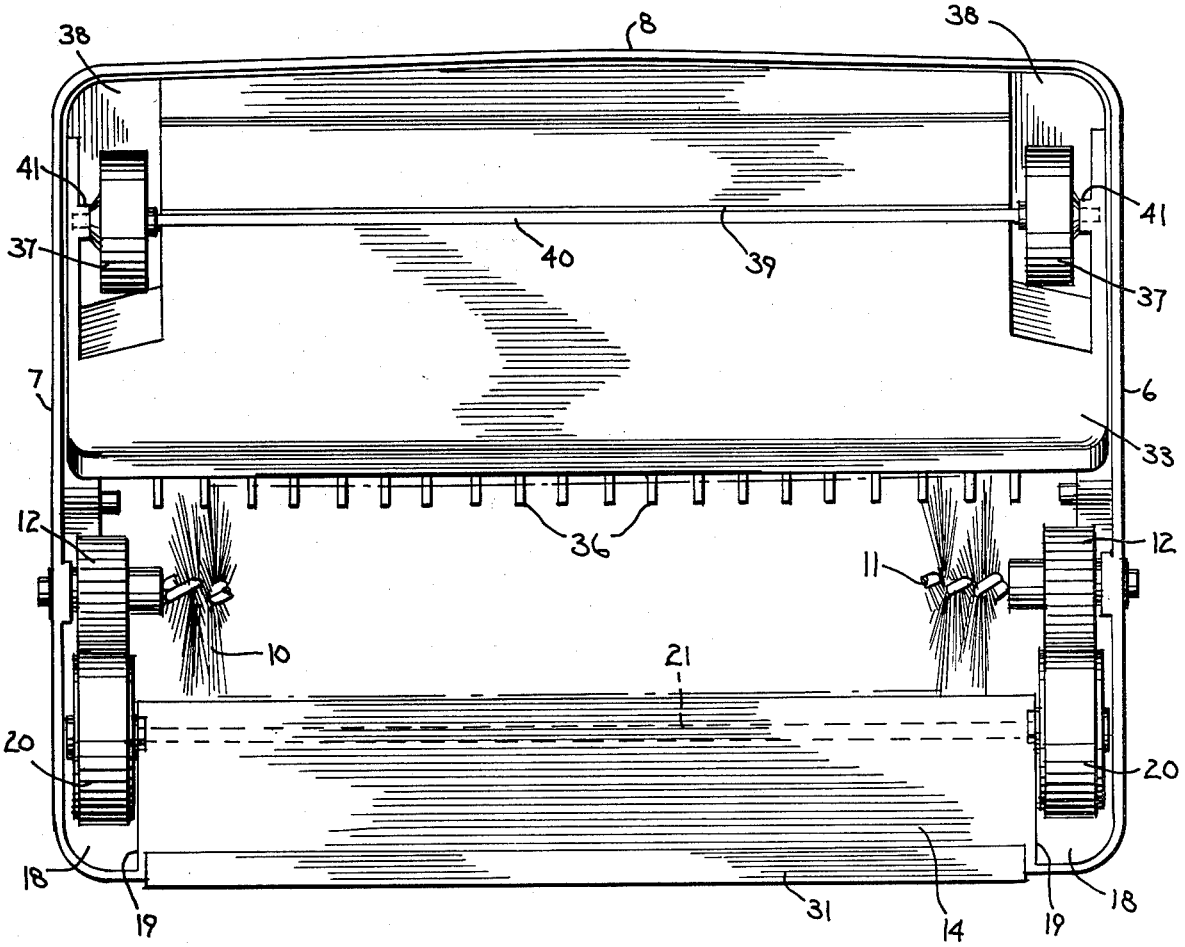
FIG. 2 is a bottom plan view of the sweeper with parts broken away for purposes of clarity.
Figure 3:
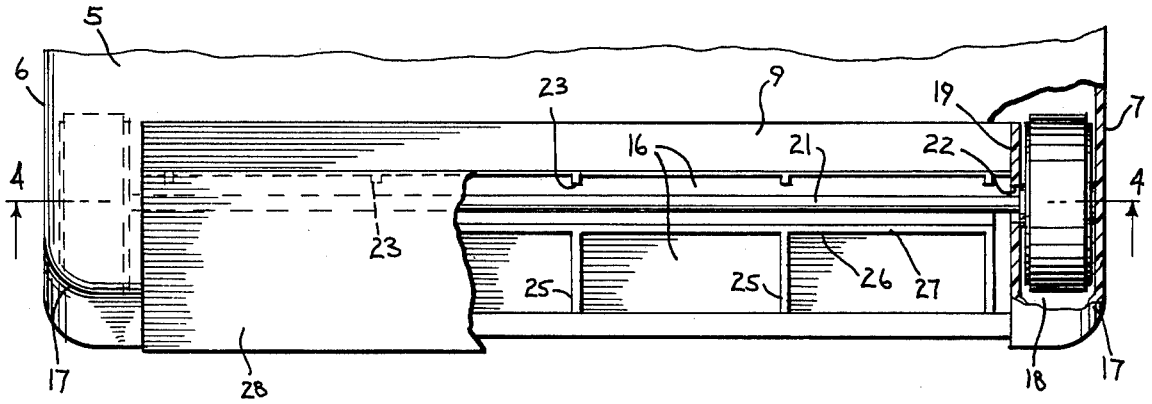
FIG. 3 is a fragmentary top plan view of the front end of the sweeper with parts broken away.

As shown in the drawings, the floor sweeper of the invention includes a handle 1 which is threadably connected to a bail 2, which in turn is mounted to a lower sweeping unit 3 in any suitable manner. Unit 3 comprises a rectangular integral relatively rigid plastic housing 4 having a top 5, end walls 6, 7, a rear wall 8, and a front wall 9.

Housing 4 is adapted to mount substantially all of the functional parts of the sweeper. For this purpose, a cylindrical rotary brush 10 is disposed beneath the housing and extends transversely between end walls 6 and 7. The brush axle 11 is suitably journalled in openings in the said end walls, and the usual coupling wheels 12 are disposed thereon, just inwardly of the walls.

Figure 5:
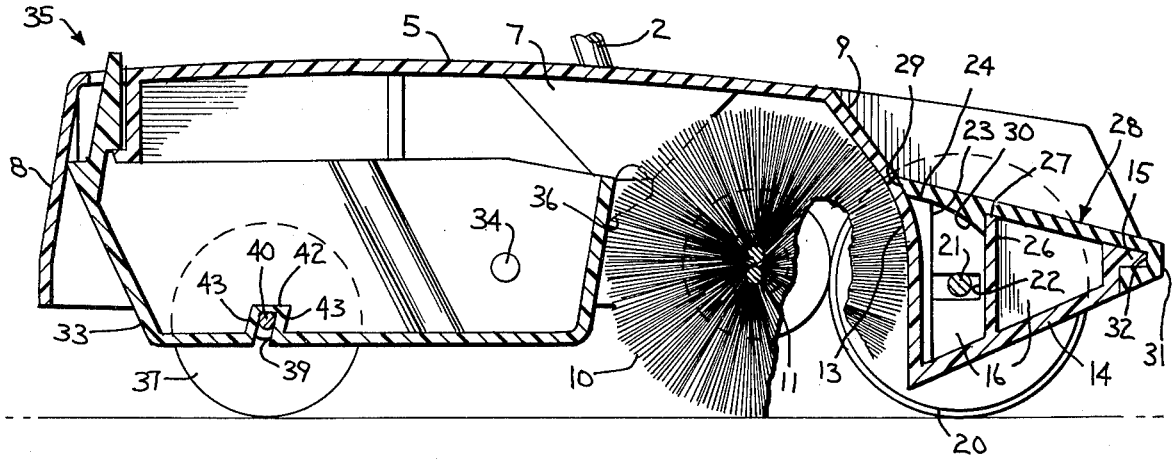
FIG. 5 is a central longitudinal section through the sweeper, taken on line 5—5 of FIG. 1.

Means are provided forwardly of brush 10 to deflect dirt and debris upwardly over the brush and toward the rear of housing 4. For this purpose, front wall 9 is set back from the front edge of the lower unit and, beneath the housing, extends downwardly from its line of merger with top 5 to form a generally curved integral deflector 13 disposed closely adjacent the ends of the brush bristles. See FIG. 5. For strenghening purposes, an integral front end element, such as platform 14, extends from the lower edge of deflector 13 forwardly to the front of the sweeper. As shown, platform 14 is inclined upwardly and terminates in a lip-like edge 15 which is disposed substantially below the plane of top 5 and forms the front terminus portion of housing 4. The exposed faces of deflector 13 and platform 14 form a transversely extending upwardly facing trough-like channel 16.

Deflector 13, platform 14 and channel 16 are shorter than the width of housing 4, thereby forming a pair of forwardly facing shoulders 17. Shoulders 17 form a pair of downwardly facing recesses 18, with the latter having inner walls 19 at the ends of the channel, with the outer walls thereof constituting the housing end walls.

Recesses 18 are adapted to receive a pair of front running wheels 20. Wheels 20 are freely mounted on the ends of an axle 21 which freely extends through slots 22 in inner walls 19 and hence through the full length of the channel 16.

Figure 4:
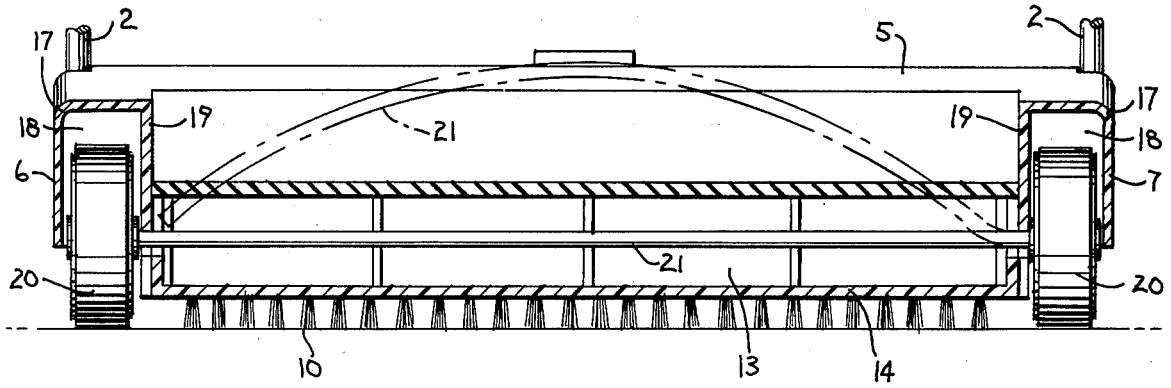
FIG. 4 is a transverse section taken on line 4—4 of FIG. 3.

Wheels 20 may be easily assembled to housing 4. For this purpose, axle 21 is made to be at least slightly bendable. One wheel 20 is manually held in one of the recesses 18, and one end of axle 21 is passed outwardly through the adjacent slot 22 and through the wheel hub. Axle 21 is then bent, as shown in phantom in FIG. 4, so that its other end can be inserted into the opposite slot 22 and hence through the hub of the second wheel being held in the other recess.

Once the wheels have been installed, they are trapped in place solely by outer walls 6, 7, inner walls 19 and axle 21. No additional parts are required.

Channel 16 provides suitable access to axle 21 for installation and removal of front wheels 20.

Upon forward translation of the sweeper over a floor, axle 21 is caused to shift rearwardly in slots 22 so that front wheels 20 engage coupling wheels 12 to thereby drive brush 10. Rearward translation causes axle 21 to shift forwardly in slots 22 to disengage the positive drive. No biasing springs are needed. The system may function similarly to the unidirectional brush rotation concept disclosed in U.S. Pat. No. 3,457,575.

The unitary construction is such that the interior of channel 16, as well as axle 21, would normally be exposed to view and also subject to the undesirable collection and possible interference of dirt and debris. Therefore, removable means are provided to fully enclose the channel to protect axle 21, said removable means also serving in the embodiment shown as a bumper for the front of the sweeper.

For this purpose, the lower portion of the exposed front face of deflector 13 is provided with a plurality of spaced ribs 23 having upper terminus portions 24. Ribs 23 are disposed rearwardly of axle 21 in channel 16. Likewise, a plurality of spaced ribs 25 are disposed forwardly of axle 21 in channel 16 and are integrally connected between platform 14 and an upstanding transverse strut 26 having an upper edge portion 27.

A cover 28 is provided and is adapted to cooperate with ribs 23 and 25, as well as strut 26 and lip 15 to protectively enclose channel 16 and act as a bumper. Cover 28 is made from a resilient flexible stretchable plastic material, such as vinyl, and comprises an elongated strip of substantially greater width than thickness. The length of cover 28 is substantially equal to the distance between the inner walls 19 of recesses 18. The rear cover edge 29 is angled to conform to the contour of deflector 13. See FIG. 5. Spaced forwardly of edge 29, and on the underside of the cover, a thin lip 30 faces slightly downwardly and forwardly. The front edge of cover 28 is turned under in a reverse fold, as at 31, to provide a rearwardly facing groove 32.

Cover 28 is assembled to housing 4 by loosely positioning it generally horizontally over channel 16 so it is supported by ribs 23 and 25 as well as strut 26, stretchably pulling it forwardly so that lip 30 is deformably engaged tightly behind strut 26 and so that fold 31 is disposed forwardly of edge 15, and then releasing the cover so that groove 32 envelopes edge 15. The manner of assembly may be progressive, such as by starting at one end and finishing at the other.

The width of cover 28 is such that, when it is attached to housing 4, it extends forwardly of and between shoulders 17 to form a thin bumper strip for protecting furniture and the like from engagement by the sweepers.

A molded plastic dust pan 33 is disposed behind brush 10, and is adapted to pivot about a pair of mounting pins 34 on the opposed housing end walls 6 and 7. A suitable latch mechanism 35 cooperatively and releasably holds pan 33 in closed position. The usual comb teeth 36 are disposed along the pan's forward edge.

Dust pan 33 is adapted to carry the rear wheels 37 of the sweeper. For this purpose, a pair of recesses 38 face downwardly from the pan ends, and a transverse slot 39 is formed in the bottom face of the pan floor and extends between the recesses. Slot 39 receives the axle 40 for the wheels. Lugs 41 on the outer recess walls hold the axle and wheels in place.

Slot 39 forms a corresponding transverse raised rib 42 on the inner floor of pan 33, said rib having a pair of generally vertical side walls 43 which tend to prevent any substantial shifting of dirt and debris in a fore and aft direction as the sweeper is moved to and fro over the floor.

Various modes of carrying out the invention are contemplated as being within the scope of the following claims particularly pointing out and distinctly claiming the subject matter which is regarded as the invention.

We claim:

1. In a floor sweeper having a handle and a bail attached to said handle, a lower sweeping unit attached to said bail and comprising:

(a) housing of integrally molded relatively rigid plastic material and with said housing having a top and downwardly depending peripheral end and rear walls, (b) a cylindrical rotary brush extending transversely between said end walls, (c) a housing front wall depending downwardly from the front edge of said top and with said front wall being set back from the front end of the lower unit, (d) said front wall being at least partially curved to form a dust deflector disposed just forwardly of said brush, (e) a platform integral with the lower end of said front wall and extending forwardly therefrom to form an edge at the front of the housing, said edge being disposed substantially below the plane of said top, (f) said front wall and platform forming a transversely extending upwardly facing channel, (g) running wheels disposed at the front end of said housing, (h) a transverse axle joining said wheels and extending through said channel, (i) and a removable protective channel cover of resilient material disposed below said top and extending generally horizontally between said front wall and the said front edge of said platform.

2. The floor sweeper of claim 1:

(a) wherein the length of said channel is less than the width of said housing to thereby form a pair of forwardly projecting front shoulders, (b) said shoulders forming downwardly facing wheel-receiving recesses having inner walls at the ends of said channel and having outer walls formed by the said housing end walls.

3. The floor sweeper of claim 2 wherein:

(a) said axle passes freely through openings in said inner walls of said recesses, (b) said wheels are freely mounted on the ends of said axle within said recess, (c) and said wheels are trapped in position solely by said inner and outer recess walls and said axle.

4. In the floor sweeper of claim 1 or 2:

(a) an upstanding strut extending transversely of said housing within said channel and disposed forwardly of said axle, said strut having an upper edge portion, (b) said cover being made of stretchable material and being stretched between the said upper edge portion of said strut and the said edge of said platform and forming a bumper for the front edge of said lower unit.

5. The floor sweeper of claim 4 wherein:

(a) said cover has rear and forward edge portions, is of substantially greater width than thickness, and includes:

(1) a forwardly facing lip disposed forwardly of the said rear edge portion, and (2) a reverse fold on the said front edge portion and with said fold forming a groove, (b) and when said cover is disposed over said channel, said lip deformably engages the said upper edge portion of said strut and said groove receives the said edge of said platform.

6. The floor sweeper of claim 4:

(a) wherein said cover has a rear edge portion, (b) and which includes means disposed on said housing front wall to support the said rear edge portion of said cover.

7. The floor sweeper of claim 6 wherein the said rear edge portion of said cover is formed to conform with the contour of said housing front wall.

8. The floor sweeper of claim 2 wherein said cover extends forwardly of said shoulders.

9. In the floor sweeper of claim 1 or 2:

(a) a dust pan of molded plastic material disposed rearwardly of said brush and pivotally mounted to said housing, said pan having a floor and carrying running wheels, (b) a raised transverse rib projecting upwardly from and integral with said floor within said pan, (c) the underside of said rib forming a downwardly facing slot, (d) and a transverse axle joining said rear wheels and with said axle being disposed in said slot.

10. In a floor sweeper having a handle and a bail attached to said handle, a lower sweeping unit attached to said bail and comprising:

(a) a housing of integrally molded relatively rigid plastic material and with said housing having a top and downwardly depending peripheral end and rear walls, (b) a cylindrical rotary brush extending transversely between said end walls, (c) a housing front wall depending downwardly from the front edge of said top and with said front wall being set back from the front end of the lower unit, (d) said front wall being at least partially curved to form a dust deflector disposed just forwardly of said brush, (e) running wheels disposed at the front of said housing, (f) a dust pan of molded plastic material disposed rearwardly of said brush and pivotally mounted to said housing, said pan having a floor and carrying rear running wheels, (g) a raised transverse rib projecting upwardly from and integral with said floor within said pan, (h) the underside of said rib forming a downwardly facing slot, (i) and a transverse axle joining said rear wheels and with said axle being disposed in said slot.

11. In a floor sweeper having a handle and a bail attached to said handle, a lower sweeping unit having a top and with said unit being attached to said bail and comprising:

(a) a housing of relatively rigid plastic material and with said housing having downwardly depending peripheral end and rear walls, (b) a cylindrical rotary brush extending transversely between said end walls, (c) a housing front wall depending downwardly from the front edge of the top of said unit and with said front wall being set back from the front end of the lower unit, (d) said front wall being at least partially curved to form a dust deflector disposed just forwardly of said brush, (e) a front end element integral with the lower end of said front wall and extending forwardly therefrom to form the front terminous portion of the housing, said terminous portion being disposed below the plane of said top, (f) said front wall and front end element forming a transversely extending upwardly facing channel, (g) running wheels disposed at the front end of said housing, (h) a transverse axle joining said wheels and extending through said channel, (i) and a channel cover extending generally horizontally and forwardly from said front wall to the forward portion of said front end element.

12. The floor sweeper of claim 11 wherein said cover forms a bumper for the front end of said lower unit.

* * * * *

UNITED STATES PATENT AND TRADEMARK OFFICE

CERTIFICATE OF CORRECTION

PATENT NO. : 4,282,622

DATED : August 11, 1981

INVENTOR(S) : Henry J. Rosendall & Arlan J. Schaffer

It is certified that error appears in the above-identified patent and that said Letters Patent are hereby corrected as shown below:

Column 4, Line 22, after "(a)" and before "housing" insert ---a---;

Column 5, Lines 31 to 32, after "carrying" and before "running" insert ---rear---.

Signed and Sealed this

*Twenty-seventh* Day of *October 1981*

[SEAL]

*Attest:*

GERALD J. MOSSINGHOFF

*Attesting Officer*

*Commissioner of Patents and Trademarks*